United States Patent [19]

Adrian et al.

[11] 4,430,854

[45] Feb. 14, 1984

[54] PROCESS AND APPARATUS FOR ENERGY RECOVERY FROM SOLID FOSSIL INERTS CONTAINING FUELS

[75] Inventors: Fritz Adrian, Ratingen; Hans-Joachim Pogrzeba, Essen, both of Fed. Rep. of Germany

[73] Assignee: Steag AG, Essen, Fed. Rep. of Germany

[21] Appl. No.: 275,768

[22] Filed: Jun. 22, 1981

[30] Foreign Application Priority Data

Jun. 28, 1980 [DE] Fed. Rep. of Germany ..... 3024474
Jun. 28, 1980 [DE] Fed. Rep. of Germany ..... 3024478

[51] Int. Cl.[3] ..... F02C 3/26
[52] U.S. Cl. ..... 60/39.02; 60/39.181; 60/39.464
[58] Field of Search ..... 60/39.02, 39.12, 39.18 B, 60/39.46 S, 39.464, 39.182; 122/4 D

[56] References Cited

U.S. PATENT DOCUMENTS 4,086,758 5/1978 Harboe ..... 60/39.02
4,255,926 3/1981 Heyn et al. ..... 60/39.12
4,281,510 8/1981 Cetrelli et al. ..... 60/39.464
4,287,838 9/1981 Moynihan et al. ..... 122/4 D
4,342,192 8/1982 Heyn et al. ..... 60/39.18 B

FOREIGN PATENT DOCUMENTS 35783 9/1981 European Pat. Off. .
1003517 9/1965 United Kingdom
1427184 3/1976 United Kingdom
1542862 3/1979 United Kingdom
1544002 4/1979 United Kingdom

*Primary Examiner*—Louis J. Casaregola
*Attorney, Agent, or Firm*—Andrus, Sceales, Starke & Sawall

[57] ABSTRACT

In an apparatus and process for energy recovery from solid fossil, inerts containing fuels the fuel is burned in a pressurized fluidized bed reactor for operating a gas turbine and a steam turbine. The flue gases of the fluidized bed are cleaned of injurious materials before introduction into the gas turbine. The gases are sharply cooled before material removal and warmed to gas turbine temperatures after removal.

14 Claims, 3 Drawing Figures

Figure 1:
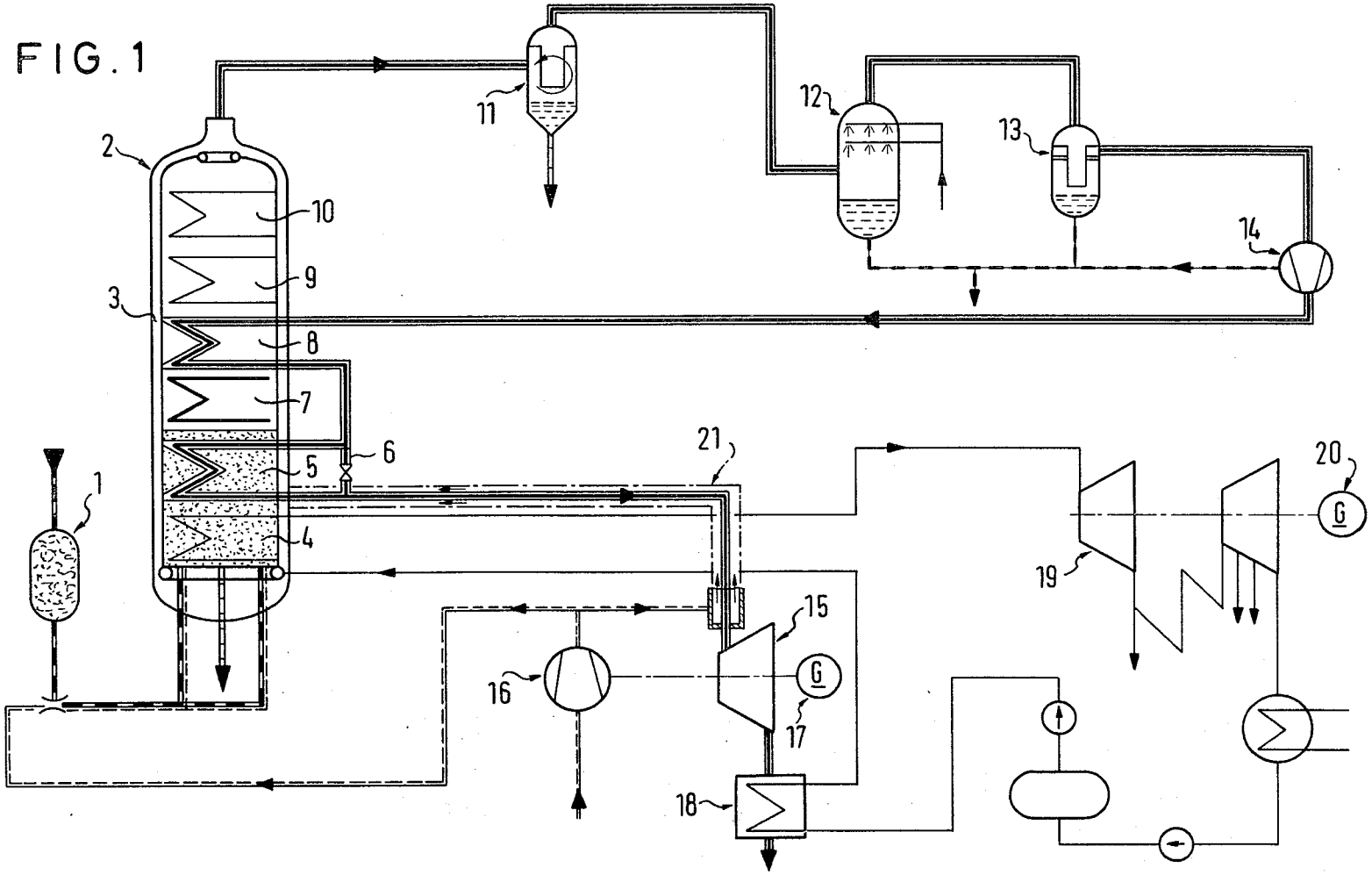

PROCESS AND APPARATUS FOR ENERGY RECOVERY FROM SOLID FOSSIL INERTS CONTAINING FUELS

The invention relates to a process and apparatus for recovering energy from solid, fossil fuels containing inert material.

There is already known a so-called combiblock with pressure fluidized bed combustion, in which the hot flue gas emerging from the pressure fluidized bed combustion with a temperature of less 900° C. laden with ash is supplied to a cyclone device or a E-filter for dust removal. In this connection, it is practical to discharge the entire amount of ash from the fluidized bed combustion, so that the subsequent filters are correspondingly loaded. The difficulties with this process lies, in particular, with the flue gas dust removal that must be carried out with high temperature, high pressure, and high ash loading. It has been pointed out that with this known process with the associated cyclone apparatus, the necessary cleanliness of the flue gases for a gas turbine operation with respect to dust content is not attainable and that with the high pressure losses corresponding to highest possible dust removal operation, such a dust removal apparatus is uneconomical for the reasons of overall thermal efficiency. An associated E-filter results in a very large construction size with high temperature and high pressure so that these E-filters are not suitable for large apparatuses. Also, the necessary flue gas cleanliness can not be obtained with an E-filter with respect to the dust content.

Finally, a process is known (VDI-Report Number 322, 1978) by which a pressure free fluidized bed combustion is coupled with a hot air turbine and a steam turbine process. By contrast to the combiblock with pressure fired fluidized bed combustion, this known process possesses the disadvantage that it requires a very large overall construction size. Also, the flue gas cleaning occurs at the end of the device at discharge gas temperature so that almost the entire ash content must take part in the course of the flue gas cooling. This leads very quickly to considerable fouling of the heat transfer surfaces necessary for the steam process and therewith to an overall reduction of the thermal efficiency of the apparatus.

The object of the present invention is to provide an apparatus and process of very high thermal efficiency in which solid, inert containing, fossil fuels may be used in a pressure fluidized bed reactor to drive electrical energy producing gas and steam turbines. The difficulties occurring with the cleaning of the gas generated in the fluidized bed are avoided.

Another object consists further in the provision of an apparatus that makes possible a problem free gas cleaning with smallest possible construction volumes.

According to the invention the flue gases generated in the fluidized bed are sharply cooled before removal of injurious material and reheated to the gas turbine inlet temperature after removal of the injurious material.

The essence of the invention occurs in that the gas cleaning is carried out with correspondingly low flue gas temperatures so that conventional gas cleaning components can be used. This makes possible, in connection with the pressure operation of the device, the use of small size construction elements. The heat released by the cooling of the flue gases is added to the steam turbine process so that a portion of the heat is used for the reheating of the exhaust gases to gas turbine temperature.

Through the combination of the gas turbine process and the steam turbine process a relatively high thermal efficiency is obtained. Preferably the flue gas is cooled before entrance in the gas cleaning to approximately 30° K. (Kelvin) above the condensation temperature so that at this temperature almost all conventional gas cleaning processes can be applied, such as fabric filter, E-filter, wet cleaning and the like, without the described difficulties of the initially described known processes with regard to the difficult dust separation and the relatively large construction sizes.

The pressure washer preferably provided for the gas cleaning makes possible the washing out of many injurious materials and, in particular, chlorine, fluorine, as well as their hydrogen compounds, alkali metals, heavy metals, and the like.

Moreover, it is advantageous if, after the injurious material cleaning, a controllable amount of compressed air is supplied to the flue gases heated by a portion of the heat released by the combustion before introduction in the gas turbine. Simultaneously the high temperatures occurring before the gas turbine are lowered so that a protected gas turbine process is the result. There thus results also lower temperatures in the waste heat boiler, so that no additional evaporation takes place in the waste heat boiler and thus the steam side conditions in the fluidized bed reactor are guaranteed also with part load.

In a particularly preferable manner, a controllable partial flow of the combustion air conducted to the fluidized bed reactor is supplied to the flue gas driving the gas turbine. At the same time with the proportioning of the air quantity supply to the boiler load, the adherence of the desired temperatures in the fluidized layer is also promoted by this means, so that a too high air excess in the fluidized layer by the compressor driven in the customary manner through the gas turbine is prevented.

In an advantageous manner, the amount of compressed air supplied to the flue gas is controlled through the temperature of the exhaust gases ahead of the gas turbine and the temperature prevailing in the waste heat boiler.

It is also preferable that the heat released by the combustion is used for the heating of the steam for the steam turbine process, whereby the steam outside of the fluidized bed is preheated through the heat contained in the flue gases. Through the pre-superheater and an injection cooler preferably acting on the steam supplied to the superheater, the temperature of the final superheater stressed particularly through heat in part load and peak load operation is lowered, so that these measures in connection with the supply of combustion air to the flue gas ahead of the gas turbine contributes to a reduction of the heat requirement of the apparatus components.

If a controllable partial flow of the flue gas after injurious material cleaning without heat loading is bypassed around the fluidized bed, what can thus result through a by-pass connection, is that a heat displacement from the gas to the steam cycle and reverse is possible. Relevantly, the temperature of the flue gases ahead of the gas turbine can be regulated with the bypass connection. Likewise in this connection, also an influencing of the temperature in the fluidized bed is possible.

A simple realization of an apparatus for the carrying out of the process according to the invention is obtained in that between a compressor provided for the supply of the fluidized bed reactor with combustion air and the flue gas conduit leading from the reactor to the gas turbine, a by-pass connection is connected. In this manner also, a too high air excess in the fluidized layer through the air compressor customarily driven from the gas turbine is prevented, so that undesired heat transfers in the after connected heat transfer surfaces in the pressure fluidized bed reactor are precluded.

A particularly simple solution in reference to construction is achieved in that the by-pass connection opens in the flue gas supplying inner pipe of a double jacket pipe, in the outer pipe of which is provided with combustion air to the reactor in flow opposition to the flue gas.

A good regulating opportunity is guaranteed in that a valve is arranged in the by-pass connection. Preferably this valve is actuated by a temperature sensor that is arranged in the region of the fluidized bed, the gas turbine and/or the waste heat boiler. A careful treatment of the superheating surfaces particularly stressed with the transfer of the load from the gas to the steam cycle is achieved in that a preheater is connected to these. Preferably an injection cooler is arranged in the conduit leading from the preheater to the superheater so that the temperature in the final superheater can be lowered.

In the following, exemplary embodiments of the invention are described with the aid of the figures. It is shown therein:

FIG. 1 a schematic representation of an apparatus with flue gas cooling prior to injurious material removal.

Figure 2:
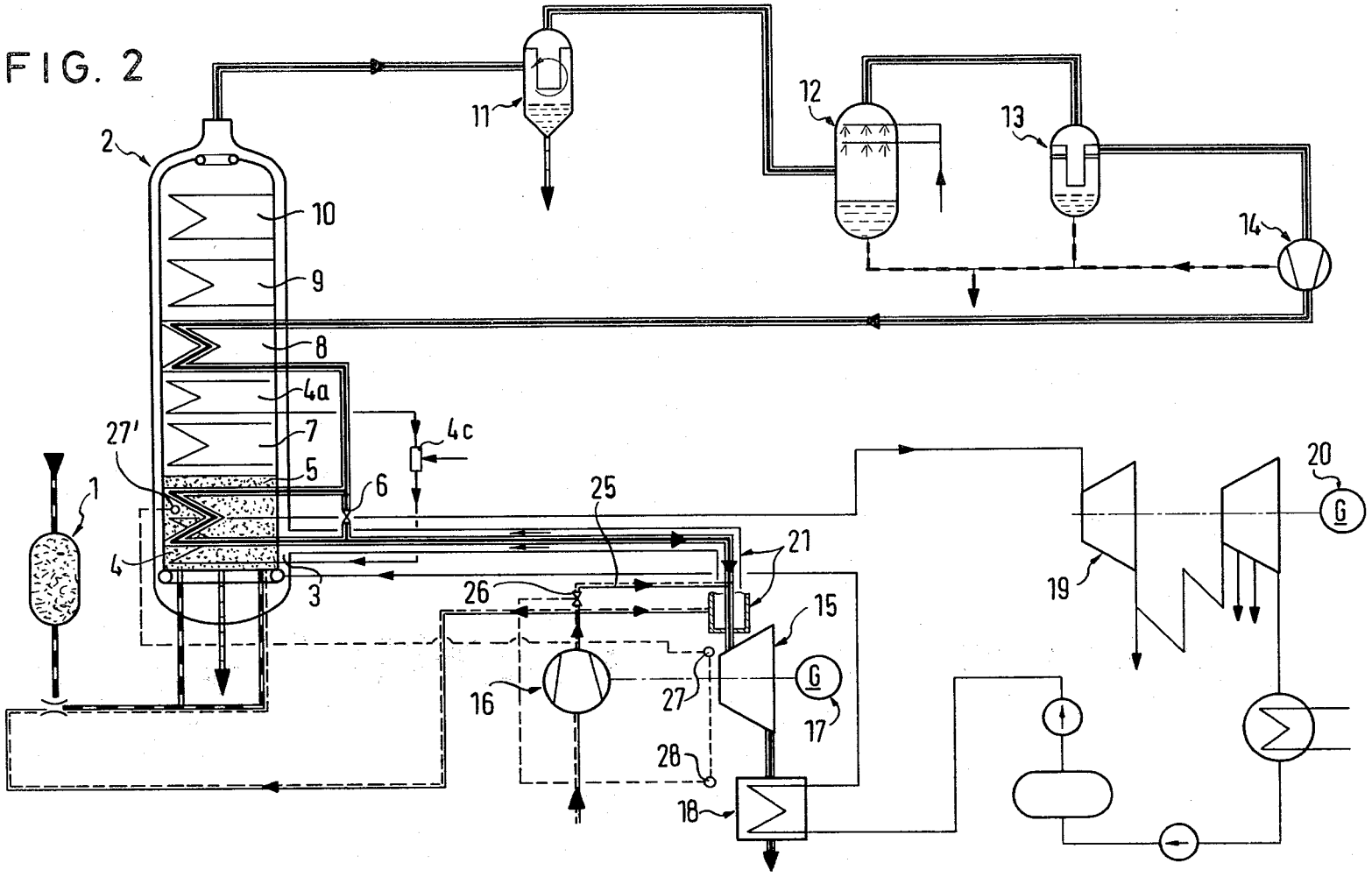
Figure 3:
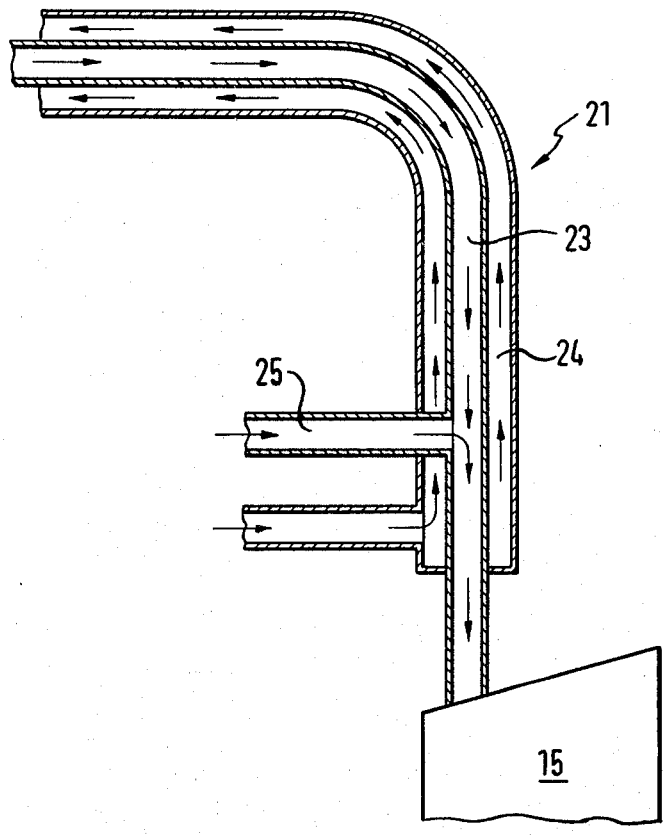

FIG. 2 a representation of an apparatus with additional supply of compressed air before the introduction of the flue gases in the turbine and FIG. 3 a detail of the flue gas conduit of FIG. 2 leading to the gas turbine.

The device shown in FIG. 1 serves for the combustion of solid, fossil and inerts containing fuels, in particular coal, that is mixed with lime in a mixing device 1 in accordance with the necessary sulfur separation in the pressure fluidized bed reactor. The mixing apparatus is connected to a charging device, not further shown, through which the fuel is delivered to the pressure fluidized bed reactor 2 through a pneumatic conveying conduit. Beside the fuel addition, compressed combustion air is injected from the base of the pressure fluidized bed reactor through nozzles there. The combustion air which preferably has a temperature of approximately 350° C., is produced through a compressor 16 further explained below. In the pressurized bed of the reactor occurs the combustion of the fuel, through which flue gases are produced.

The pressure fluidized bed reactor formed as a double jacketed construction 3 comprises an outer pressure wall and an inner wall formed through fin and tube walls. The fin and tube walls are part of the evaporation system of the steam process. In the intermediate hollow space formed thereby combustion air is supplied through the compressor 16 with a temperature of approximately 350° C. in an opposite flowing process further described below.

Apparatus for the removal of injurious materials are connected downstream of the pressure fluidized bed reactor 2, namely a cyclone separator 11 for dust removal, a pressure washer 12 and a spray separator 13. The flue gas produced in the pressure fluidized bed reactor through combustion of the fuel is fed after conduction through the injurious material removal apparatus through a pressure increasing compressor 14, before it is delivered eventually to the gas turbine 15 subsequent to the reheating further described below.

For the reheating of the cleaned gas, two gas heaters are provided in the pressure fluidized bed reactor, namely a preheater 8 which is arranged outside of the fluidized bed in a moderate temperature range of the flue gas in the pressure fluidized bed reactor of approximately 400° to 750° C., and a final heater 5 arranged in the fluidized bed. Between the flue gas supply to the final heater and the flue gas discharge of the final heater to the gas turbine a by-pass conduit 6 is provided with one or more regulating valves.

For the operation of the steam turbine, a superheater 4 is provided in the lower region of the fluidized bed, from which a conduit leads to a steam turbine 19. Outside of the fluidized bed, two further steam producing heat transfer surfaces are provided in the region of the pressure fluidized bed reactor, which are incorporated in the steam turbine process. In particular there is referred to in this connection an intermediate superheater 7 positioned between the preheater 8 and the final heater 5 for the flue gases and a high pressure coil 9 and a lower pressure coil 10. These latter steam producing heat transfer surfaces serve for the further cooling of the converted flue gases, as is further described subsequently.

Between the walls of reactor 2 flows something above 80% of the compressed combustion air supplied through the compressor, that has a temperature of approximately 350° C.

The fuel mixture injected in the fluidized bed is burned with a temperature slightly below 900° C. and at a pressure of approximately 10 bar, in the course of which the combustion air necessary in this connection is injected by the compressor beneath the fluidized layer through the nozzle base.

Through the addition of the lime to the fuel, the sulfur released from the coal is combined into calcite so that a desulfurization occurs inside the pressure fluidized bed furnace.

The heat released by the combustion is supplied through the superheater 4 to the steam turbine process and through the final heater 5 serves for the warming of the flue gases to gas turbine temperature. The further cooling of the flue gases results inside the pressure fluidized bed reactor as by the intermediate superheater 7, the high pressure coil 9 and the lower pressure coil 10, as well as through the preheater 8 for the flue gases. Additionally, the water cooled walls 3 of the fluidized layer and the subsequent heat exchanger take up heat. At the same time, the flue gases are cooled to approximately 30° K. (Kelvin) above the condensation temperature so that the flue gases exiting out of the pressure fluidized bed reactor possess a temperature of approximately 130° C. (10 bar).

The cooled flue gases are then supplied to the cyclone separator 11 for course separation and then subjected to a wet cleaning in the pressure washer 12. In this connection the gas is cooled with simultaneous saturating out to approximately 100° C. For improved injurious material removal, such as chlorine, fluorine, and their hydrogen compounds, the wash water can be treated with an alkali solution. As a result of the wet cleaning carried out under pressure, the apparatus can be maintained essentially smaller and is also given an improved reaction result during the wash. Finally, the flue gas cleaned of dust and injurious materials is delivered to the spray separator (13) serving as residual spray separator and subsequently to the pressure compressor 14. After passage through the spray separator 13, the flue gases are subjected to a secondary compression in the pressure increasing compressor 14 and finally supplied to the preheater 8. Through the imposition of the intermediate superheater 7 between the preheater 8 and the final heater 5, crack formation in the heat transfer surfaces of the preheater as a result of temperature shocks through entrained water particles are avoided. The flue gases warmed in the preheater 8 to a temperature of approximately 400° to 500° C. are then supplied to the final heater 5, the heat transfer surfaces of which are fully embedded in the fluidized bed. There thus results an intensive heat transfer to the cleaned gas to be heated, that is enhanced through the fluidized bed firing under pressure. In the final heater the flue gases are heated to a suitable temperature for the gas turbine process, namely a temperature of slightly below 900° C. or equal to 900° C.

A portion of the flue gases can be by-passed around the final heater 5 through the by-pass conduit 6 provided with one or more regulating valves. In this way the temperature of the flue gases supplied in the gas turbine can preferably be regulated. Also, a control of the heating surfaces in the fluidized layer is thus possible. On the basis of the by-pass conduit is also a measure of influence on the temperature relationships inside the fluidized bed possible according to the partial amount of the flue gases supplied in the by-pass. There can thus be undertaken a heat displacement from the steam turbine process to the gas turbine process and reverse.

The flue gas heated to the gas turbine temperature is supplied in a double pipe construction 21 to the gas turbine 15, whereby combustion air in the opposite flow process is supplied from the compressor 16 to the pressure fluidized bed reactor.

Preferably the pressure of the air supplied to the reactor in the outer pipe of the double wall pipe 21 develped through the compressor 16 is somewhat greater than the pressure of the secondarily compressed flue gases through the compressor 14, which is advantageous on grounds of facility of the double pipe construction acted upon in the inner pipe with the hot flue gases. On the basis of the double pipe construction, it is also prevented that, with a defective inner pipe, hot gases can emerge in the environment, to the contrary the pressurized air would flow into the inner pipe. As a result of the gas sided pressure operation, the mechanical pressure strains are likewise largely precluded on the side of the gas heaters 5 and 8. The heat transfer surfaces of the gas heaters are stressed thus solely by temperature.

The flue gas conducted in the gas turbine is expanded and cooled in this connection to approximately 450° C. The gas turbine 15 drives the air compressor 16, that supplies the air necessary for the combustion and a generator 17 that produces the electrical energy. The flue gas cooled in the gas turbine arrives eventually in the waste heat boiler 18, where it is used for the feed water heating for the steam process and is thereby cooled to approximately 110° C.

Waste heat boiler 18, evaporator 3, superheater 4, intermediate superheater 7, high pressure coil 9 and low pressure coil 10 thus form the heat transfer installation for the steam process. The steam turbine drives a generator 20 for the production of electrical energy.

With the exemplary embodiments according to FIGS. 2 and 3, a presuperheater 4*a* is arranged between the intermediate-superheater 7 and the flue gas preheater 8.

The heat transfer surfaces for the steam lead to the steam turbine, so that the presuperheater 4*a* is connected after the superheater 4 and an injection cooler 4*c* is provided in the connection conduit.

From FIGS. 2 and 3 it is apparent that a connection leads from compressor 16 to the base of the pressure fluid bed reactor, through which fuel carrier air is injected in the reactor. A further connection leads from the compressor to the double jacket pipe 21, the connection point being more precisely seen in FIG. 2. A by-pass conduit 25 leads as well from the compressor 16 to the double jacket pipe 21 and opens in the inner pipe 23 of the double jacket pipe 21 ahead of the gas turbine 15. In this connection, the pressure produced through the compressor 16 is somewhat greater than the pressure in the flue gas. In the outer pipe 24 flows compressed combustion air from the compressor 16 into the double wall intermediate space of the reactor 2 and from there out to the base of the fluidized bed and is there injected through nozzles in the fluidized layer.

In the by-pass connection 25 a valve 26 is arranged. The valve 26 can be controlled through with temperature sensors 27, 27′ or 28 which are arranged in the region of the gas turbine 15, the fluidized bed reactor, or the waste heat boiler 18.

Through the by-pass connection 25 compressed combustion air can be supplied to the heated flue gas before the introduction in the gas turbine 15 so that the gas turbine 15 can be operated with a controllable amount of gas and the temperature ahead of the gas turbine can be reduced. Simultaneously in this connection, the combustion process and the temperature condition in the heat transfer surfaces in the fluidized bed reactor can be influenced through the remaining air amount supplied to the fluidized bed reactor.

We claim:

1. A process for generating energy from solid fossile fuels containing inerts in at least one of a steam turbine and a gas turbine, said process comprising the steps of:
   - supplying said fuel to a pressure fluidized bed in a reactor;
   - burning said fuel in the reactor with the aid of compressed combustion air supplied to the reactor for generating heat and flue gases in the reactor;
   - supplying water to the reactor to generate steam with the heat;
   - supplying the steam to the steam turbine;
   - sharply cooling the flue gases inside the reactor by heat exchange with at least one fluid passed through the reactor;
   - cleaning, under pressure, the cooled flue gases of injurious material caused by the inerts;
   - passing at least a portion of the cooled and cleaned flue gases through the reactor to reheat the cooled flue gases;
   - supplying the heated, cleaned flue gases to a gas turbine; and
   - passing the compressed combustion air to the reactor in counter-current gas-gas heat exchange relation with the reheated flue gases.

2. The process according to claim 1 wherein the flue gases are cooled inside the reactor but outside the fluidized bed by heat exchange with at least one of the water and steam in the reactor and the cleaned flue gases the reactor.

3. The process according to claim 1 further defined as passing a portion of the flue gases through the reactor outside of the bed and a portion of the flue gases through the pressure fluidized bed to reheat the flue gases.

4. The process according to claim 3 further including the step of bypassing a portion of the cooled, cleaned flue gases around the fluidized bed and admixing the bypassed portion to the flue gases reheated in the fluidized bed.

5. The process according to claim 4 further defined as bypassing a selected portion of the gases to control the temperature of at least one of the fluidized bed and flue gases to the gas turbine.

6. The process according to claim 1 further defined as admixing a controllable partial flow of the compressed combustion air to the reheated flue gases to control the operation of the gas turbine.

7. The process according to claim 6 further defined as controlling the admixture of compressed air in accordance with at least one of the temperature of the flue gases at the inlet of the gas turbine, the temperature of the pressure fluidized bed, and the temperature existing in a waste heat boiler through which the exhaust gases of the turbine pass in heat transfer relationship with the water supplied to the reactor.

8. The process according to claim 1 further defined as generating steam from the water by preheating with the flue gases and heating with the fluidized bed.

9. The process according to claim 8 further defined as injection cooling the steam between the preheating and heating steps.

10. The process according to claim 1 wherein the flue gases are cooled before the cleaning of the injurious material to approximately 30° K. (Kelvin) above condensation temperature.

11. The process according to claim 1 wherein the flue gases are reheated before supply to the gas turbine to a temperature of about 900° C.

12. The process according to claim 1 further defined as compressing the cooled and clean flue gases before reheating in the reactor.

13. The process according to claim 1 further including the step of pressure washing the flue gases.

14. The process according to claim 1 further defined as desulfurizing the fuels in the pressure fluidized bed reactor through the addition of lime.

* * * * *